US005438494A

United States Patent [19]

Harlan

[11] Patent Number: 5,438,494

[45] Date of Patent: Aug. 1, 1995

[54] LIGHT HOLDER FOR HEAD GEAR

[76] Inventor: Benjamin L. Harlan, 6935 Country Corner La., Orlando, Fla. 32809

[21] Appl. No.: 125,758

[22] Filed: Sep. 29, 1993

[51] Int. Cl.[6] ..... F21L 15/14

[52] U.S. Cl. ..... 362/106; 362/105; 362/396; 248/229; 24/3.9

[58] Field of Search ..... 362/103, 105, 106, 191, 362/396, 418; 24/3 E, 3 F, 339; 248/229, 316.1, 687

[56] References Cited

U.S. PATENT DOCUMENTS

| | | | |
|---|---|---|---|
| 1,393,158 | 10/1921 | Pawsat | 248/229 |
| 1,471,985 | 10/1923 | Tower | 362/396 |
| 1,681,595 | 8/1928 | Ray | 248/229 |
| 1,774,775 | 9/1930 | Weitz, Jr. | 362/396 |
| 1,846,345 | 2/1932 | McCarten | 248/229 |
| 2,042,385 | 5/1936 | Boring | 248/229 |
| 2,439,623 | 4/1948 | Howells | 248/229 |
| 2,585,592 | 2/1952 | Sears | 240/59 |
| 2,765,398 | 10/1956 | Mays | 240/59 |
| 3,249,271 | 5/1966 | Allbritton | 224/25 |
| 3,769,663 | 11/1973 | Perl | 24/81 |
| 4,462,064 | 7/1984 | Schweitzer | 362/105 |
| 4,969,069 | 11/1990 | Eichost | 362/105 |

*Primary Examiner*—James C. Yeung
*Assistant Examiner*—Y. Quach
*Attorney, Agent, or Firm*—Edward M. Livingston

[57] ABSTRACT

A head-gear-light holder has a leaf-spring strap that is sized and shaped cylindrically to be wrapped circumferentially around a cylindrical outside periphery of a flashlight body. Opposite circumferential ends of the leaf-spring strap are extended perpendicularly to an axis of a cylindrical shape of the leaf-spring strap at circumferential positions between which a gap having a select width is provided for drawing the opposite circumferential ends of the leaf-spring strap together in the gap to tighten a cylindrical inside periphery of the leaf-spring strap against an outside periphery of the flashlight body in a grasping relationship. At least one fastener orifice is provided in each of the opposite circumferential ends of the leaf-spring strap. A threaded end of a fastener shaft is inserted through a fastener orifice in each of the opposite circumferential ends of the leaf-spring strap. A mating-threaded fastener member is then screwed onto the fastener shaft in a direction towards a fastener base with the opposite circumferential ends of the leaf-spring strap positioned intermediate the fastener base and the mating-threaded fastener member such that the opposite circumferential ends of the leaf-spring strap are drawn together in the gap to tighten the leaf-spring strap onto the flashlight body. The fastener shaft can be a fastener bolt positioned on each opposite side of a fire-fighter helmet to hold a faceplate on the fire-fighter helmet. The fastener base can be a portion of fire-fighter helmet crown into which the fastener shaft is screwed. It is described for use on head-gear bands, hats, caps and helmets.

4 Claims, 4 Drawing Sheets

FIG. 9
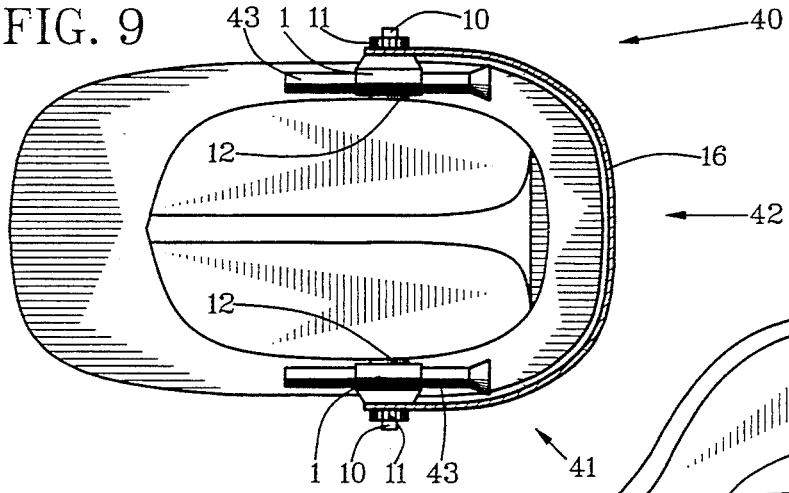
FIG. 10
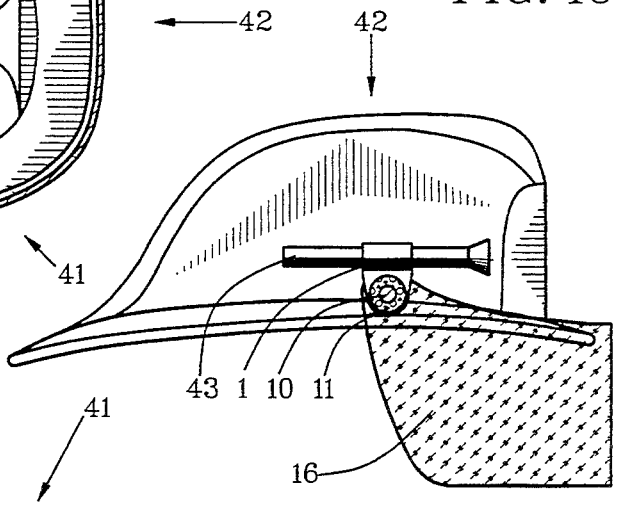
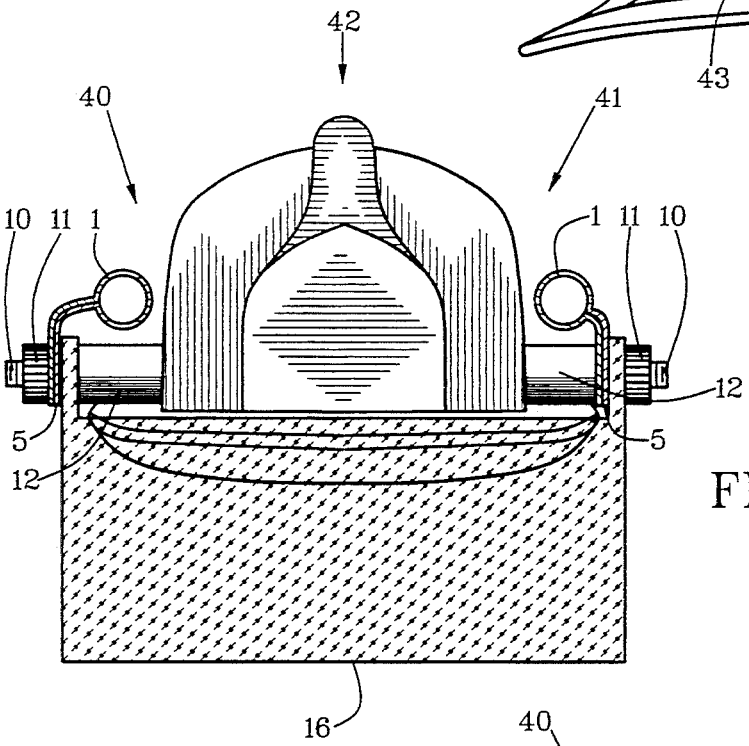
FIG. 11
FIG. 12
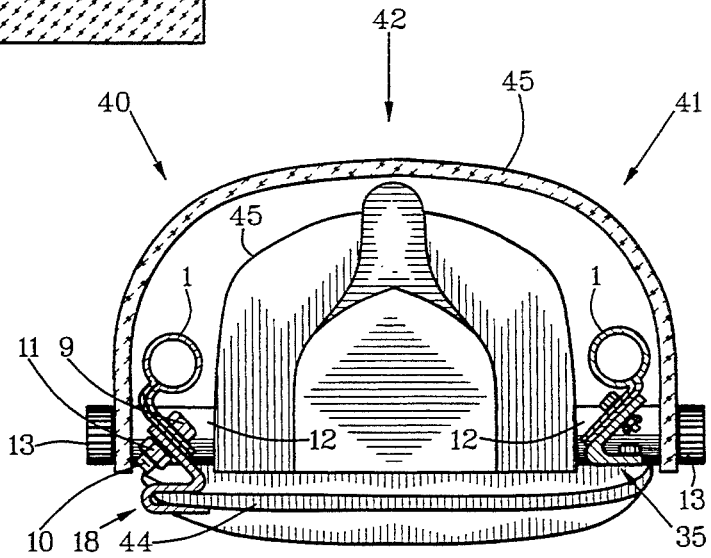

LIGHT HOLDER FOR HEAD GEAR

BACKGROUND OF THE INVENTION

This invention relates to holders for attachment of lights to head gear such as fire-fighter helmets, hats, caps and head bands.

Lights have long been attachable centrally to a front portion of mining helmets and other types of hard hats used for construction, maintenance and other working conditions. But fire-fighter helmets and most other hats and caps require discretionary attachment of lighter and more adjustable lights. Previously, holders for lights attachable to fire-fighter helmets have been either clipped onto a brim or bolted to a crown proximate the brim. Lights attachable to construction helmets have been belted on like a mining light. None have been attachable onto a side post in a manner taught by this invention. Heat resistance and minute weight of special small lights with high lighting capacity make side attachment to faceplate bolts particularly significant for fire-fighter helmets. Typically, such special lights are pen-sized flashlights that weigh only one-to-several ounces but have the lighting capacity of large flashlights. They are advantageous also for caps similar to baseball caps and for a wide variety of hats and helmets with various types of brims and crowns. The light holder taught by this invention is advantageous for all types of hats, helmets, caps and head bands.

The clip-on and bolt-on light holders used in the fire-fighter industry are not known to be described in issued patents. Nor are some types of hatband lights that fit onto various helmets like a hatband with the light facing forward from the front of the helmets. But neither are adjustable. The clip-on types do not stay on reliably. The bolt-on type sacrifice structural integrity of fire-fighter helmets. Neither are attachable with adequate reliability to other types of helmets or to hats and caps. Also, known types have C-spring clamps that do not hold the lights reliably. The hatband types position lights in front where they are too easily damaged by head-butting conditions of fire fighting.

Patented light holders include a headband device for holding a flashlight as described in U.S. Pat. No. 4,970,631 granted to Marshall. The Marshall patent employed Velcro ® strips for attaching a flashlight to a headband. It did not have pivotal adjustment as taught by this invention. U.S. Pat. No. 2,765,398 granted to Mays taught a flashlight holder on top of a cap with a chin strap to hold it in place. U.S. Pat. No. 4,969,069 granted to Eichost taught opposing pairs of C-clamps to hold flashlights on earphones. U.S. Pat. No. 4,998,187 granted to Herrick taught a helmet-top light holder with an acute dihedral structure in which a flashlight was held with a strap from opposite surfaces of the dihedral structure. U.S. Pat. No. 3,249,271 granted to Allbritton described two C-clamps juxtaposed on a rigid strip that was pivotal on a fastener shaft at a side of a headband. These and other patents are examples of different types of light holders on head gear. No light holders like this invention are known or believed to exist.

SUMMARY OF THE INVENTION

In light of problems that have existed and that continue to exist in this field, objectives of this invention are to provide a head-gear flashlight holder that is:

- Attachable to a side of head gear including, but not necessarily limited to, a fire-fighter helmet, a laborer helmet, a hot-weather helmet, a hat, a cap or a headband;
- Light in weight to prevent tipping of the head gear with weight of the holder;
- Producible in small sizes to hold small flashlights that are light enough in weight to prevent tipping of the head gear with combined weight of the flashlight and the holder;
- Pivotal in a vertical plane with the head gear oriented horizontally in order to provide vertical adjustment of light beam from a flashlight;
- Fixable with tightness onto an outside surface of a flashlight to prevent the flashlight from falling from the holder;
- Attachable to existing fastener shafts that hold faceplates on conventional fire-fighter helmets;
- Fire-resistant; and
- Non-corrosive.

This invention accomplishes the above and other objectives with a leaf-spring strap that is sized and shaped cylindrically to be wrapped circumferentially around a cylindrical outside periphery of a flashlight body. Opposite circumferential ends of the leaf-spring strap are extended perpendicularly to an axis of a cylindrical shape of the leaf-spring strap at circumferential positions between which a gap having a select width is provided for drawing the opposite circumferential ends of the leaf-spring strap together in the gap to tighten a cylindrical inside periphery of the leaf-spring strap against an outside periphery of the flashlight body in a grasping relationship. At least one fastener orifice is provided in each of the opposite circumferential ends of the leaf-spring strap. A threaded end of a fastener shaft is inserted through a fastener orifice in each of the opposite circumferential ends of the leaf-spring strap. A mating-threaded fastener member is then screwed onto the fastener shaft in a direction towards a fastener base with the opposite circumferential ends of the leaf-spring strap positioned intermediate the fastener base and the mating-threaded fastener member such that the opposite circumferential ends of the leaf-spring strap are drawn together in the gap to tighten the leaf-spring strap to hold the flashlight body or provide close proximity to slip-retardant surfaces of the leaf-spring strap. The fastener shaft can be a fastener bolt positioned on each opposite side of a fire-fighter helmet to hold a faceplate on the fire-fighter helmet. The fastener base can be a portion of firefighter helmet crown into which the fastener shaft is screwed. Also for use on a fire-fighter helmet, the mating-threaded fastener member can be a faceplate wheel which functions as a fastener nut on each fastener shaft. For other types of head gear such as laborer helmets, sun helmets, hats, caps and headbands, the fastener shaft can be a fastener bolt that is inserted into a fastener orifice in a clasp that is attachable to a band, a brim or a crown of the head gear.

BRIEF DESCRIPTION OF THE DRAWINGS

This invention is described by appended claims in relation to description of a preferred embodiment with reference to the following drawings which are described briefly as follows:

FIG. 9 is a top view of a fire-fighter helmet having a small flashlight attached to a faceplate shaft on each side of a fire-fighter helmet to demonstrate attachment to either or both sides with the FIG. 1 embodiment;

FIG. 10 is a side view of the FIG. 9 illustration;

FIG. 11 is a front elevation view of a fire-fighter helmet having a flashlight holder mounted directly on a faceplate shaft between a faceplate wheel and a faceplate on the left side and between the faceplate and a faceplate boss on the right side to demonstrate optional forms of attachment with the same light holder;

FIG. 12 is a front elevation view of a fire-fighter helmet with a light holder attached to a brim of the helmet with a clip-on bracket on the left and with a bolt-on bracket on the right of the helmet to demonstrate use of different types of brackets for attachment of this head-gear-light holder;

DESCRIPTION OF THE PREFERRED EMBODIMENTS

Figure 1:
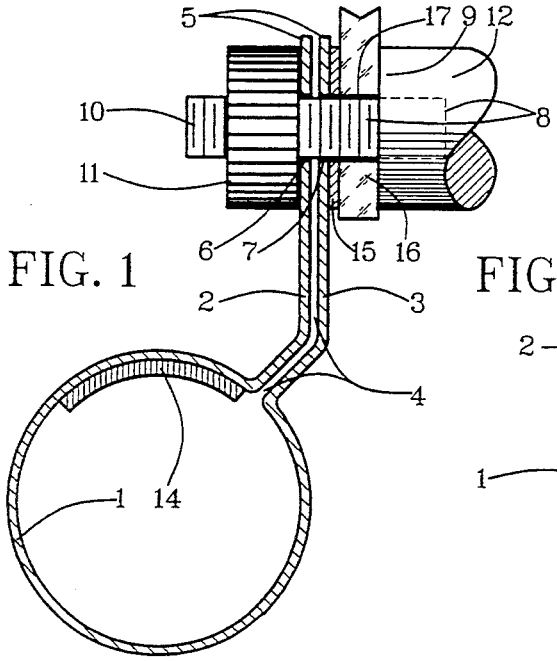
FIG. 1 is an end view of a head-gear-light holder for use on a fire-fighter helmet by mounting it directly on a faceplate shaft.
Figure 2:
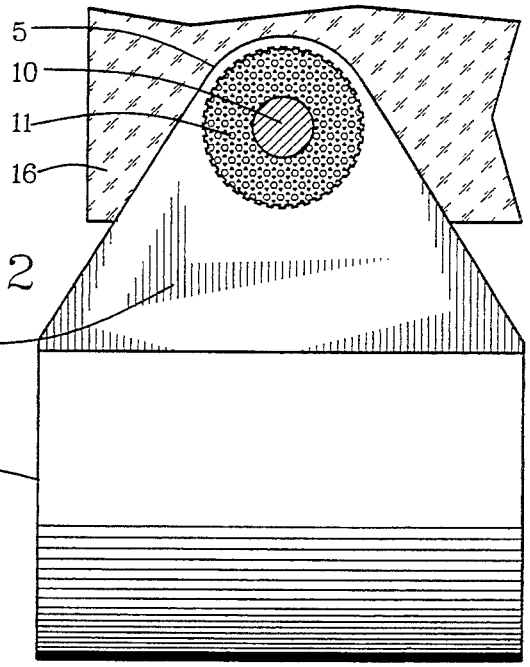
FIG. 2 is a side elevation view of the FIG. 1 illustration.

Reference is made first to FIGS. 1–2. A leaf-spring strap 1 is sized and shaped cylindrically to be wrapped circumferentially around a cylindrical outside periphery of a flashlight body. Opposite circumferential ends 2 and 3 of the leaf-spring strap 1 are extended outward perpendicularly to a cylindrical configuration of the leaf-spring strap 1 between which ends 2 and 3 a closure gap 4 is formed linearly to the axis of the cylindrical configuration of the leaf-spring strap. The circumferential ends 2 and 3 can be bent as desired for attachment to particular head gear but the closure gap 4 continues to a fastener tip 5 where fastener orifices 6 and 7 are positioned in respective opposite ends 2 and 3 of the leaf-spring strap 1. The fastener tip 5 is comprised of both ends 2 and 3 shaped for convenience of use in relationship to construction of different types of head gear and attachment means with which this head-gear-light holder is attachable. With axes of the two fastener orifices 6 and 7 positioned in line concentrically, a fastener-bolt shaft 8 with a fastener-bolt base 9 juxtaposed to an outside surface of one of the circumferential ends 2 or 3 of the leaf-spring strap 1 is inserted in the fastener orifices 6 and 7 with a fastener end 10 of the fastener-bolt shaft 8 extended through a circumferential end 2 or 3 opposite the fastener-bolt base 9 for screwing a mating-threaded fastener member 11 onto the fastener end 10 of the fastener-bolt shaft 8.

The fastener-bolt base 9 can be a faceplate boss 12 as shown in FIGS. 1–2 and 9–11, a bolt head as shown in FIGS. 3–8 and 12 or an attachment means as shown in FIGS. 13–16. The mating-threaded fastener member 11 can be a faceplate wheel as shown in FIGS. 1–2 and 9–11 or other type of hand-turnable nut 13 as shown in FIGS. 3–8 that is screwed onto the fastener end 10 of the fastener-bolt shaft 8. Alternatively, the fastener-bolt shaft 8 can be a bolt type with a rigid faceplate wheel that can be screwed into the fastener-bolt base 9 as shown in FIG. 12. The fastener-bolt base 9 can be a faceplate boss also as shown in FIG. 12.

The mating-threaded fastener member 11, faceplate wheel or other hand-turnable nut 13 is screwed in the direction of the fastener-bolt base 9 to cause the two circumferential ends 2 and 3 of the leaf-spring strap 1 to be drawn together. This closes or decreases the closure gap 4 in a gripping action to tighten the leaf-spring strap 1 onto a flashlight inserted into the cylindrical configuration of the leaf-spring strap 1. A gripping substance 14 such as Velcro® can be placed on an interior of the cylindrical configuration of the leaf-spring strap 1 to aid in holding a flashlight. A faceplate washer 15 can be positioned on a desired side of a faceplate 16 at a faceplate orifice 17 in which the fastener-bolt shaft 8 is positioned.

Figure 3:
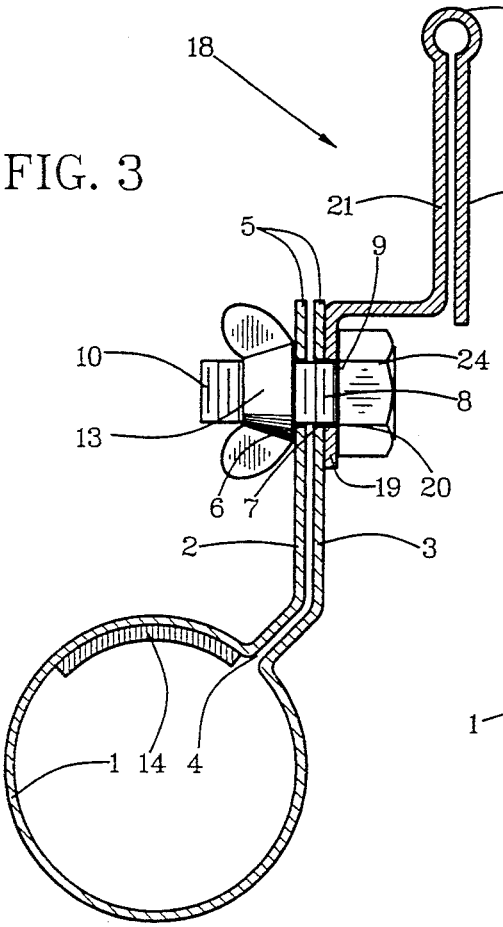
FIG. 3 is a an end view of an embodiment with a clip attachment for mounting to a brim or a band of either a fire-fighter helmet or other type of head gear.
Figure 4:
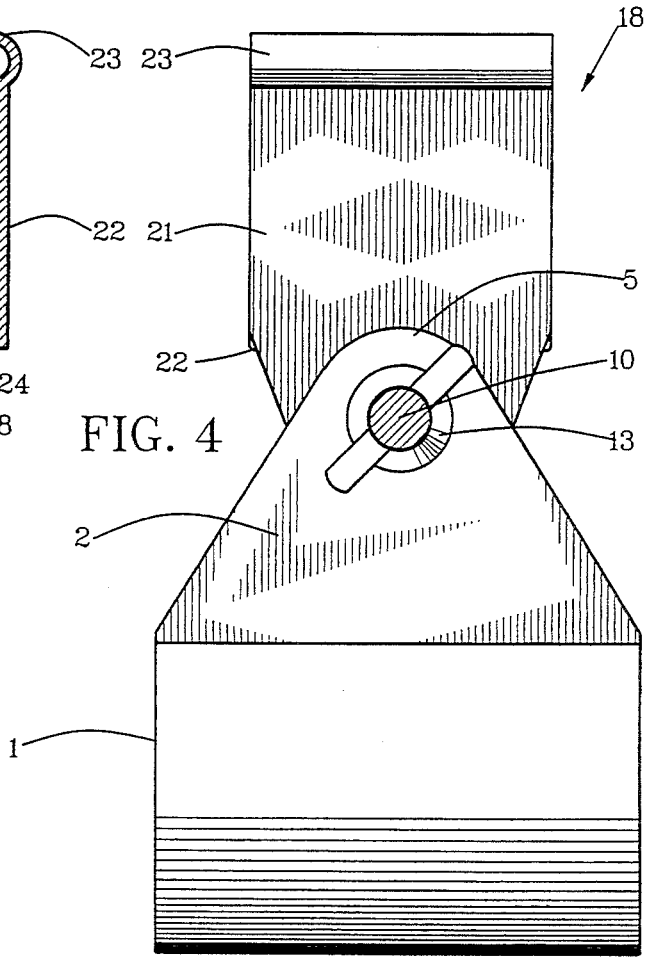
FIG. 4 is a side elevation view of the FIG. 3 illustration.
Figure 14:
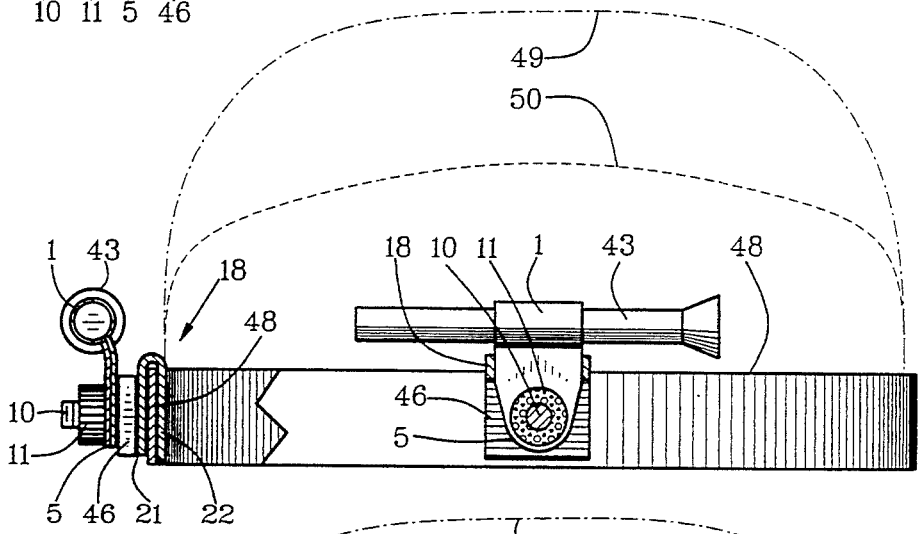
FIG. 14 is a side elevation view of a hatband with a rear view and a side view of a clip for clip-on mounting to a cap, hat, helmet or headband for attachment of this head-gear-light holder.

Referring to FIGS. 3–4, an attachment clip 18 can have an attachment end 19 with a clip-attachment orifice 20 through which the fastener-bolt shaft 8 is inserted. The attachment clip 18 has opposite clip sides 21 and 22 joined by a spring curve 23. The attachment end 19 is extended from clip side 21 and can be bent or otherwise shaped as desired for relative positioning of the clip-attachment orifice 20 and fastener orifices 6 and 7 concentrically for insertion of fastener-bolt shaft 8. The attachment clip 18 can be positioned on a brim or band of a head gear to hold a leaf-spring strap as shown in FIG. 14. The fastener-bolt base 9 can be expanded into a form of a bolt head 24.

Figure 5:
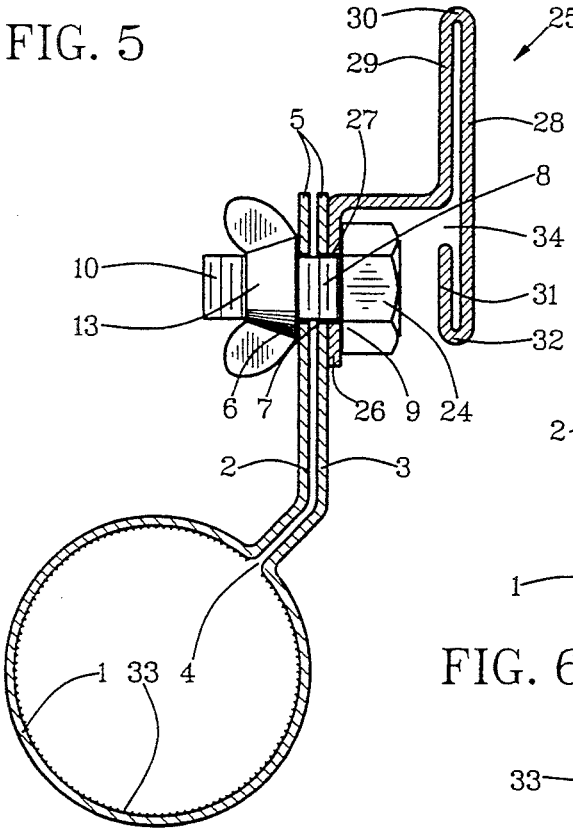
FIG. 5 is an end view of an embodiment with a clasp attachment for mounting to a band on head gear.
Figure 6:
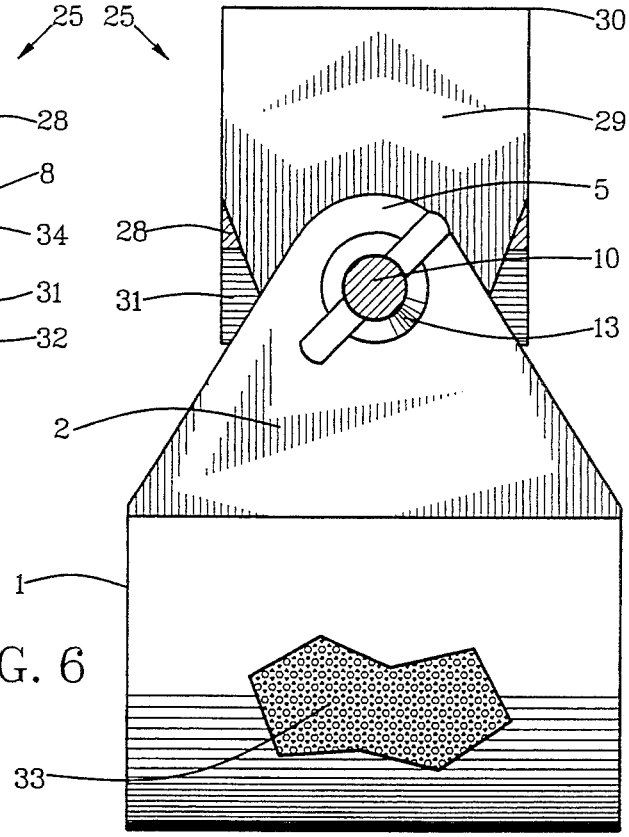
FIG. 6 is a partial cutaway side view of the FIG. 5 illustration.
Figure 15:
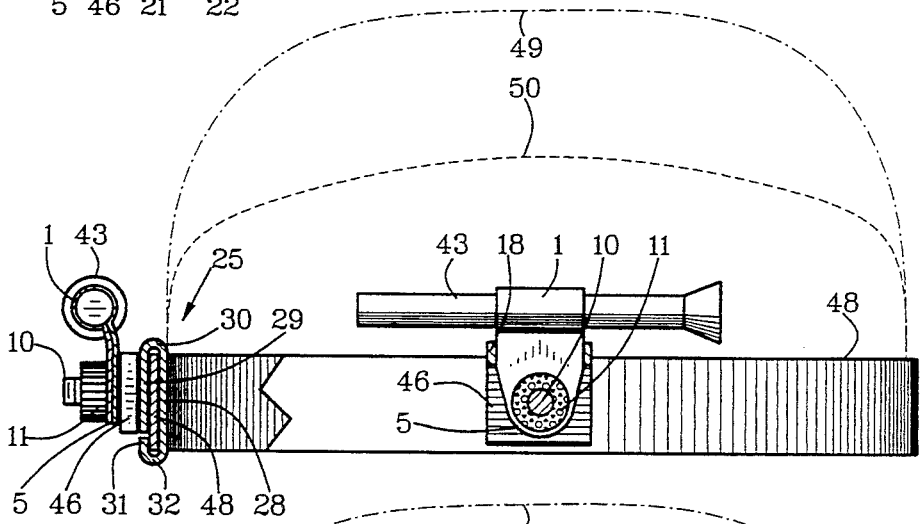
FIG. 15 is a side elevation view of a hatband with a rear view and a side view of a clasp for clasp mounting to a cap, hat, helmet or headband for attachment of this head-gear-light holder.

Referring to FIGS. 5–6, a head-gear clasp 25 can be used to attach the leaf-spring strap 1 to a band of a head gear as shown in FIG. 15. The head-gear clasp 25 has a clasp end 26 with a clasp-attachment orifice 27 that is aligned with the fastener orifices 6 and 7 for insertion of the fastener-bolt shaft 8. The attachment clasp 25 has a base plate 28 that is joined to a top front plate 29 with a top clasp curve 30. The clasp end 26 is extended from the top front plate 29. A bottom front plate 31 is joined to the base plate 28 with a bottom clasp curve 32. The leaf-spring strap 1 can have a knurled or otherwise nonskid interior surface 33 to retard slippage of a flashlight positioned in the circumferential configuration of the leaf-spring strap 1. A clasp gap 34 allows insertion of a head-gear band between the base plate 28 and the top and bottom plates 29 and 31 which are tensioned together.

Figure 7:
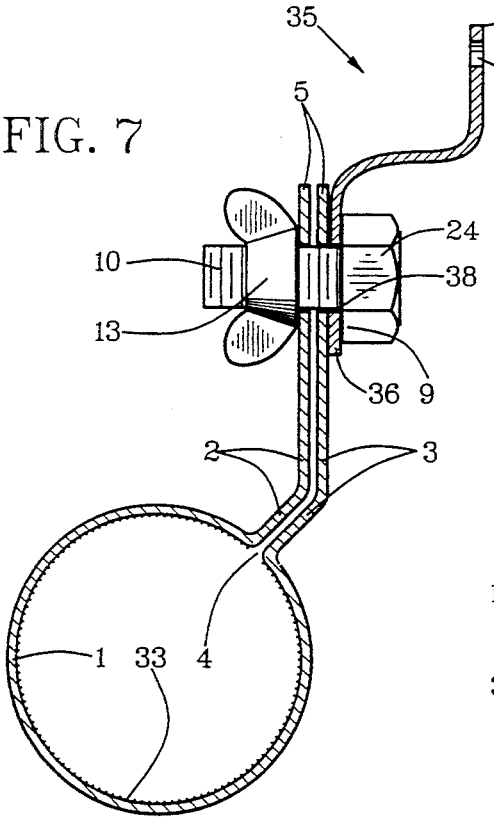
FIG. 7 is an end view of an embodiment with a bolt-on attachment bracket for mounting to a fire-fighter helmet or other type of head gear.
Figure 8:
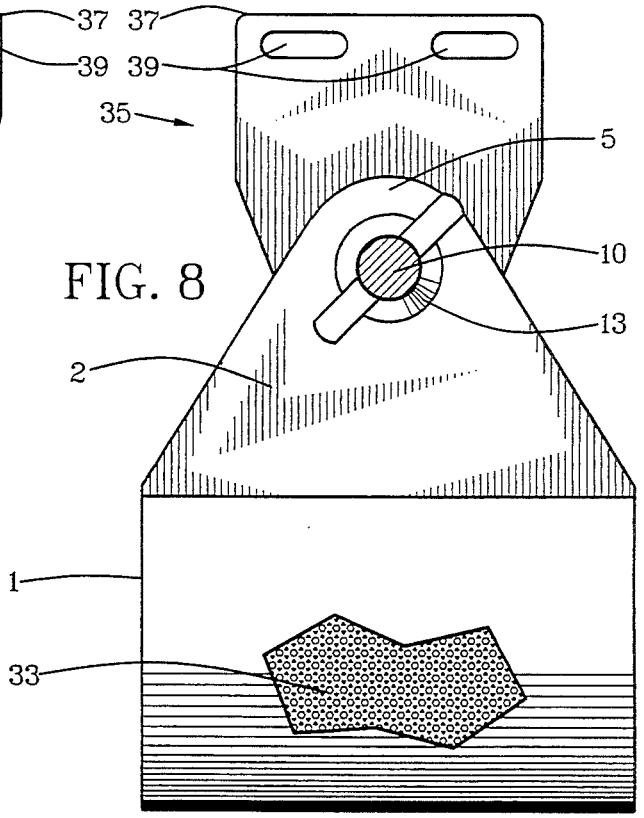
FIG. 8 is a partial cutaway side view of the FIG. 7 illustration.

Referring to FIGS. 7–8, a head-gear fastener plate 35 can be bolted, sewed, riveted or otherwise attached directly to a head-gear brim, crown or band for attachment of the leaf-spring strap 1. The fastener plate 35 has an attachment end 36 and a strap end 37. A plate-attachment orifice 38 is provided in the attachment end 36 and at least two head-gear-attachment orifices 39 are provided in the strap end 37. Bolts, thread, rivets or other fastener means are inserted through the head-gear-attachment orifices 39. The fastener-bolt shaft 8 is inserted in the plate-attachment orifice 38.

Referring to FIGS. 9–10, a leaf-spring strap 1 can be positioned on either a left side 40, a right side 41 or on both sides 40 and 41 of fire-fighter helmet 42. The leaf-spring straps 1 can be attached to the faceplate boss 12 as described in relation to FIGS. 1–2. A flashlight 43 positioned in the leaf-spring strap 1 is generally light in weight and small but high-powered. It can be pivoted to a desired angle vertically on the fastener-bolt shaft 8.

Referring to FIG. 11, the fastener tip 5 can be positioned either outside of faceplate 16 as shown on the left side of fire-fighter helmet 42 or inside of faceplate 16 as shown on the right side of fire-fighter helmet 42 for different preferences. Different curvature of the fastener tip 5 is desirable also for positioning the flashlight 43 in a desired relationship to the fire-fighter helmet 42.

Referring to FIG. 12, attachment clip 18 can be positioned on a brim 44 of a fire-fighter helmet 42 and bent for desired positioning of the leaf-spring strap 1 as shown on the left side of fire-fighter helmet 42. Head-gear fastener plate 35 can be bolted or otherwise attached to a brim 44 and bent for desired positioning of the leaf-spring strap 1 as shown on the right side of fire-fighter helmet 42. The head-gear fastener plate 35 can be attached alternatively to the crown 45 of fire-fighter helmet 42, although attachment to the brim 44 is preferable to prevent distortion of heat-resistance factors of the crown 45. A different type of attachment on each side of the helmet 42 is for illustration of different attachments only. It is not recommended that both be used, although the fastener plate 35 can be employed as a permanent attachment on one side and the attachment clip 18 as a temporary attachment for the opposite side of a fire-fighter helmet 42.

Figure 13:
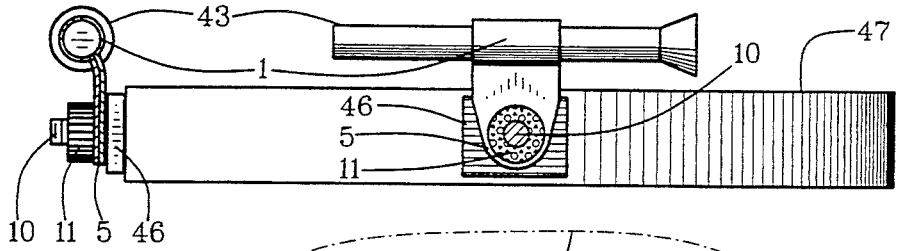
FIG. 13 is a side elevation view of a headband with a rear view and a side view of a mounting similar to the mounting of a fire-fighter helmet for attachment of this head-gear-light holder.

Referring to FIG. 13, a headband base 46 can be attached directly to a headband 47 or other head-gear band as an alternative to a fastener-bolt base 9 on an external end of a faceplate boss 12 used for a fire-fighter helmet as shown in FIGS. 1–2 and 9–12. Rear positioning and side positioning of the headband base 46 and leaf-spring strap 1 are shown only to illustrate the related features, not as a recommended positioning for holding the flashlight 43.

Referring to FIG. 14, an attachment clip 18 can be positioned on a headband or a hatband 48 of a crown 49 of a helmet or hat or on a hatband 48 of cap 50. As described in relation to FIG. 13, rear positioning and side positioning of the attachment clip 18 are shown only to illustrate the related features, not as a recommended positioning for holding the flashlight 43. When an attachment clip 18 is used with a hatband 48, a headband base 46 can be attached directly to the attachment clip 18 as shown for a fastener-bolt base 9 in the working relationship described for FIG. 13.

Referring to FIG. 15, a head-gear clasp 25 can be positioned on a headband or a hatband 48 of a crown 49 of a helmet or hat or on a hatband 48 of cap 50. As described in relation to FIGS. 13–14, rear positioning and side positioning of the attachment clasp 25 are shown only to illustrate the related features, not as a recommended positioning for holding the flashlight 43. When an attachment clasp 25 is used with a hatband 48, a headband base 46 can be attached directly to the attachment clasp 25 as shown for a fastener-bolt base 9 in the working relationship described for FIGS. 13–14. Other aspects are as described in relation to FIGS. 5–6.

Figure 16:
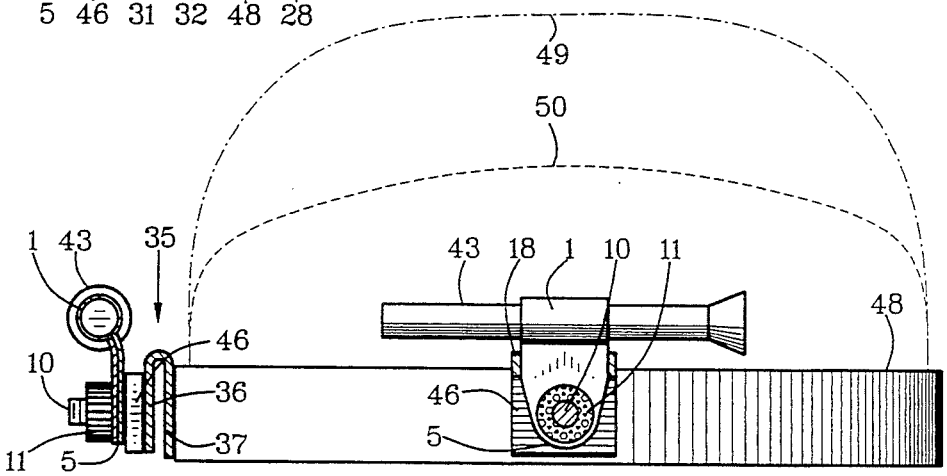
FIG. 16 is a side elevation view of a hatband with a rear view and a side view of a bracket for bolt-on or other bracket mounting to a cap, hat, helmet or headband for attachment of this head-gear-light holder.

Referring to FIG. 16, a head-gear fastener plate 35 can be positioned on a headband or a hatband 48 of a crown 49 of a helmet or hat or on a hatband 48 of cap 50. As described in relation to FIGS. 13–15, rear positioning and side positioning of the head-gear fastener plate 35 are shown only to illustrate the related features, not as a recommended positioning for holding the flashlight 43. When a head-gear fastener plate 35 is used with a hatband 48, a headband base 46 can be attached directly to the head-gear fastener plate 35 as shown for a fastener-bolt base 9 in the working relationship described for FIGS. 13–15. Other aspects are as described in relation to FIGS. 7–8 and 11.

A new and useful head-gear-light holder having been described, all such modifications, adaptations, substitutions of equivalents, mathematical possibilities of combinations of parts, applications and forms thereof as described by and foreseeable within the following claims are included in this invention.

I claim:

1. A head-gear-light holder comprising:

a leaf-spring strap sized and shaped cylindrically to be wrapped circumferentially around a cylindrical outside periphery of a flashlight body;

opposite circumferential ends of the leaf-spring strap extended outward perpendicularly to an axis of a cylindrical configuration of the leaf-spring strap between which a gap is formed linearly to the axis of the cylindrical configuration of the leaf-spring strap;

at least one fastener orifice in each of the opposite circumferential ends of the leaf-spring strap:

the fastener orifice in one of the circumferential ends of the leaf-spring strap being concentric to the fastener orifice in an opposite circumferential end of the leaf-spring strap such that two fastener orifices are positioned concentrically with axes in line;

a fastener-bolt shaft having a threaded end that is fittable snugly into the two fastener orifices;

a fastener-bolt base juxtaposed to an outside surface of one of the circumferential ends of the leaf-spring strap proximate outside peripheries of the fastener orifices in the circumferential ends of the leaf-spring strap wherein the fastener-bolt base is a bolt head having a desired shape;

a mating-threaded fastener member threadable onto the threaded end of the fastener-bolt shaft such that the opposite circumferential ends of the leaf-spring strap can be drawn together to decrease the gap selectively intermediate the circumferential ends linearly to the axis of the cylindrical configuration of the leaf-spring strap and an inside periphery of the cylindrical configuration of the leaf-spring strap can be tightened selectively against the cylindrical outside periphery of the flashlight body by screwing the mating-threaded fastener member selectively onto the fastener-bolt shaft wherein the mating-threaded fastener member is a hand-rotative nut having at least one finger-graspable member extended in a desired direction from the mating-threaded fastener member;

a head-gear clasp having a base plate;

a top front plate attached to a top of the base plate and extended downward;

a bottom front plate attached to a bottom of the base plate and extended upward;

a fastener section extended from one end of the top front plate toward the fastener-bolt shaft; and a fastener orifice of the fastener section sized and shaped to receive the fastener-bolt shaft.

2. A head-gear-light holder as described in claim 1 wherein:

the head-gear clasp is sized and shaped for passage of a desired strap between the base plate on one side and the top front plate and the bottom front plate on an opposite side of the desired strap.

3. A head-gear-light holder as described in claim 2 wherein:

the desired strap is a hat band.

4. A head-gear-light holder as described in claim 2 wherein:

the desired strap is a head band.

* * * * *